US007334355B2

(12) United States Patent
Sheridan

(10) Patent No.: US 7,334,355 B2
(45) Date of Patent: Feb. 26, 2008

(54) FOOTWEAR SUPPORT SYSTEM

(75) Inventor: Michael Francis Sheridan, Fernham (GB)

(73) Assignee: Michael Sheridan (GB)

( * ) Notice: Subject to any disclaimer, the term of this patent is extended or adjusted under 35 U.S.C. 154(b) by 310 days.

(21) Appl. No.: 11/211,870

(22) Filed: Sep. 6, 2005

(65) Prior Publication Data

US 2006/0191165 A1 Aug. 31, 2006

(51) Int. Cl.
*A43B 7/20* (2006.01)
*A43B 23/02* (2006.01)

(52) U.S. Cl. ..... 36/89; 36/109

(58) Field of Classification Search ..... 36/89, 36/90, 109, 58
See application file for complete search history.

(56) References Cited

U.S. PATENT DOCUMENTS 258,316 A * 5/1882 Reed ..... 36/58
260,069 A * 6/1882 Wallace ..... 36/89
4,338,735 A * 7/1982 Spademan ..... 36/118.1
4,447,968 A * 5/1984 Spademan ..... 36/109
4,809,686 A * 3/1989 Crane ..... 602/27
4,936,295 A * 6/1990 Crane ..... 602/29
5,588,228 A * 12/1996 Foscaro et al. ..... 36/118.2

* cited by examiner

*Primary Examiner*—Ted Kavanaugh

(57) ABSTRACT

A footwear base (320) and a structurally designed footwear bracing system (340) including a footwear base is provided. The footwear bracing system reduces the likelihood of ankle injuries when incorporated in a variety of footwear. The footwear bracing system permits the production of a very high structurally designed footwear base (320) by coupling it to and working in unison with a simple articulated but structurally designed support system (340). Very large forces can exist with this footwear and moderate but very injurious forces can be experienced in many types of footwear and these forces cannot be controlled by the ankle alone. Using the principles of the present invention these forces can be transferred to and resisted by the lower leg. The support system controls the forces generated by the footwear height or ground unevenness and relieves the ankle of this task. The support structure enables articulation of the ankle joint and therefore allows the wearer to move in a normal manner safely and with ease.

2 Claims, 14 Drawing Sheets

FOOTWEAR SUPPORT SYSTEM

The present invention relates generally to footwear and specifically to a system for providing support for a wearer.

Bracing structures for legs are known and comprise separate structures which fit around the leg. These structures are traditionally large and obtrusive frameworks used for medical purposes such as to treat injuries. Because the bracing structures are large and obtrusive and do not form part of the shoe, their use is limited to medical applications in which, because there is a therapeutic benefit, the wearer is not concerned about the appearance of the bracing structure or the fact that it must be applied separately to an item of footwear. Accordingly, known bracing structures are not suitable for integration with items of footwear.

The present invention seeks to address the problems with known bracing structures.

According to a first aspect of the present invention there is provided an item of footwear comprising a base and a bracing member, the bracing member being connected to the base and adapted to extend, in use, alongside at least part of the leg of a wearer and being adapted for compliant movement relative to the base in response to rotation of an ankle joint but for resistance to sideways flexion of an ankle joint in at least one direction, whereby to enable braced articulation of the ankle joint.

Accordingly, the present invention provides footwear with an integrated bracing structure.

In order for an individual to be able to walk without undue impedance, the bracing member must allow for rotation of the ankle joint. Rotation of the ankle joint is intended to encompass those movements which allow pivoting of the foot with respect to the leg about the axis of the ankle joint. Sideways flexion of the ankle joint is a result lateral movement of the leg with respect to the foot i.e. outwards and inwards movement, which can cause injury. Therefore the bracing member must allow for fore and aft movement of the leg whilst resisting lateral movement in order that a natural walking action can be achieved.

The bracing member may be pivotally connected to the base. Pivotal connection of the bracing member allows it to pivot backwards and forwards in unison with the backwards and forward pivoting of the leg with respect to the foot. Accordingly this component of movement of the walking action is not impeded. Alternatively, the bracing member may be fixedly connected to the base and be adapted to be flexible in a direction caused by rotation of the ankle but rigid in a direction caused by sideways flexion. An analogy of such a bracing member would be a plastic ruler, which is very flexible longitudinally, but rigid transverse its length.

The footwear base may include an elongate heel. The wearing of high-heeled footwear has existed for many years. The wearer of footwear of this type must be cautious when walking because the long thin heel is not stable and the ankle is subjected to large lateral forces in both directions because the heel cannot alone provide a stable base upon which the user's weight can be supported. Conventional designs of high-heeled shoes have no lateral support assistance and consequently this type of footwear limits the wearer to modest heights and to remain on even or level ground. By providing a high-heeled shoe base with bracing means, the stability and safety of such shoes can be greatly improved. With judicious choice of materials and positioning of the bracing member the support structure could be made discrete so as to function as a fashion item.

The present invention has facilitated the development of a new class of footwear that is characterised by extremely high heels which have a very low intrinsic stability but provide for a braced freedom of ankle movement about the shoe base using a support system which is unobtrusive. This new class of footwear may be made as a single integrated unit consisting of a very high structurally designed footwear base with a structurally matched articulated leg support system. Together they can withstand very high overturning forces that occur with extremely high heels. The structural matching of the units give support and allows flexibility to the wearer and thereby the ability to move speedily, gracefully and with confidence over a variety of surfaces.

The heel may be between approximately 20 mm and 600 mm in length. The easy use and provision of such heel structures has until now been impossible because of the increasing turning forces generated as the heel length increases and the inability of the ankle to compensate for such forces.

As the length of the heel increases it may be necessary to introduce one or more heel reinforcing members which may extend partly or along the whole length of the heel unit.

The base may further comprise a platform sole. This would be necessary once the length of the heel is increased to the point at which the incline of the foot caused by the heel becomes greater than the ankle joint could comfortably stand. Accordingly a platform sole of between approximately 1 mm and 600 mm in length may be provided. As is the case with heel members which are unusually long the platform sole portion may require one or more reinforcing members extending at least partly or entirely through the platform.

The bracing member may extend on the outside or inside of the leg only. The present invention appreciates that the less intrusive the bracing structure the more likely it would be to be incorporated into standard footwear products, in which appearance is of vital importance. The provision of bracing means on only the outside or inside of the leg would mean that a user could safely walk by deliberately applying pressure to the outer or inner bracing member and thus avoid the opposite sideways movement towards the un-braced side.

The bracing member may extend on both the outside and inside of the leg. This may be achieved by the use of a single support structure in a u shape. Alternatively two independent support bars may be used which allow a degree of independence and therefore an ability to allow some twisting.

Footwear provided by the present invention does not necessarily rely on contact with the ground for stability, but on the wearer themselves. The wearer can use their balance to maintain verticality of their upper and lower legs which are strong and allow the bracing system to remove the need to balance the ankle. This allows the wearer to move across many types of surfaces including uneven or soft ground safely and with a reduced requirement to check the ground before stepping. The effect can be that the wearers ankle is supported during use so that this greatly increases the confidence of the wearer. The result is a much more natural gait with little fear of injury. This allows the wearer to travel with speed and grace more akin to low-heeled footwear. In the case of individuals who have injuries or weak ankles, for example, the support system could be used on any shoe to help guard against further injury.

The bracing means may be provided internally or externally of the item of footwear. In one embodiment the bracing means are carried in a pocket on the exterior of a boot in the material which extends up the leg.

The bracing means may be formed as part of the structure of the item of footwear. For example, the bracing means may pass through a pocket or channel formed in the footwear so as to be unobtrusive.

The bracing member may be connected to a joint member carried on or by the base.

In one embodiment the base includes a hollow tube extending transversely across the base and a tubular or cylindrical bar fits within the tube to form a pivoting joint capable of rotation. The bar extends outwardly from the shoe base and is bent upwardly so that, in use, it extends alongside the leg of a wearer.

In one embodiment the support bar extends across the whole base forming a bearing allowing rotation but capable of resisting large sideways bending forces. The bearing can be any that can perform this task and may be a plain bearing or one using roller or needle bearings. The bearing is not a pin joint. The length of the bearing can be varied and is related to the sideways forces that are to be resisted.

The support bar has its axis of rotation through the base.

In embodiments in which a heel reinforcing member is provided it may be fixedly connected to part of the joint member, such as the hollow tube.

The item may comprise an elongate leg portion extending at least partly up the leg of a wearer in use. Accordingly the item may be footwear such as a walking boot, safety work boot, ice skating boot, ski boot, or land mine protection boot. Although the bracing members need to extend above the ankle to achieve a bracing effect, the body of the footwear does not have to extend to the same extent as the bracing member, although of course this may be preferable in some cases. Sandals can also have this bracing system incorporated.

Because the footwear may be used purely or partly for recreational purposes i.e. not purely for rehabilitation of an injury or the like, the choice of materials for the bracing structure is important. For example, the bracing structure should not be too bulky or heavy, so that the footwear appears as natural as possible. The use of the bracing system allows ice skating boots and ski boots to be made of lighter materials. Metals or plastics may be used to form strut-like members which can extend up the leg and transfer forces acting on the ankle along their length. Clear plastics could, for example, be used externally without drawing undue attention. In other embodiments the bracing member may be formed so as to deliberately form part of and complement the footwear design using its shape and colour. According to a further aspect of the present invention there is provided a footwear base comprising: a pivotal connection means; and a bracing member pivotally connected to the connection means and adapted to extend, in use, alongside at least part of the leg of a wearer and adapted for compliant movement relative to the base in response to rotation of an ankle joint but to resist sideways flexion of the ankle joint in at least one direction, whereby to enable braced articulation of an ankle joint.

The present invention may also provide a footwear support system comprising a bracing member connectable to a footwear base and adapted to extend, in use, alongside at least part of the leg of a user, and adapted for compliant movement relative to the base in response to rotation of an ankle joint but to resist sideways flexion of the ankle joint, whereby to enable braced articulation of an ankle joint.

The present invention may also provide an item of footwear comprising bracing means adapted to permit unrestricted rotation of an ankle joint in use but to resist sideways flexion of the ankle joint, whereby to enable braced articulation of the ankle joints. This produces a large reduction in the likelihood of ankle injuries from travelling on uneven ground. When incorporated into work boots for industry and walking boots the bracing system would prevent many ankle injuries The present invention may also provide a high-heel shoe comprising a heel having a length between 20 mm and 600 mm, the shoe comprising bracing means adapted to permit unrestricted rotation of an ankle joint but to resist sideways flexion of an ankle joint, whereby, in use, to enable braced articulation of an ankle joint.

The present invention will now be more particularly described, by way of example, with reference to the accompanying drawings, in which like reference numerals relate to like features and in which.

Figure 1A:
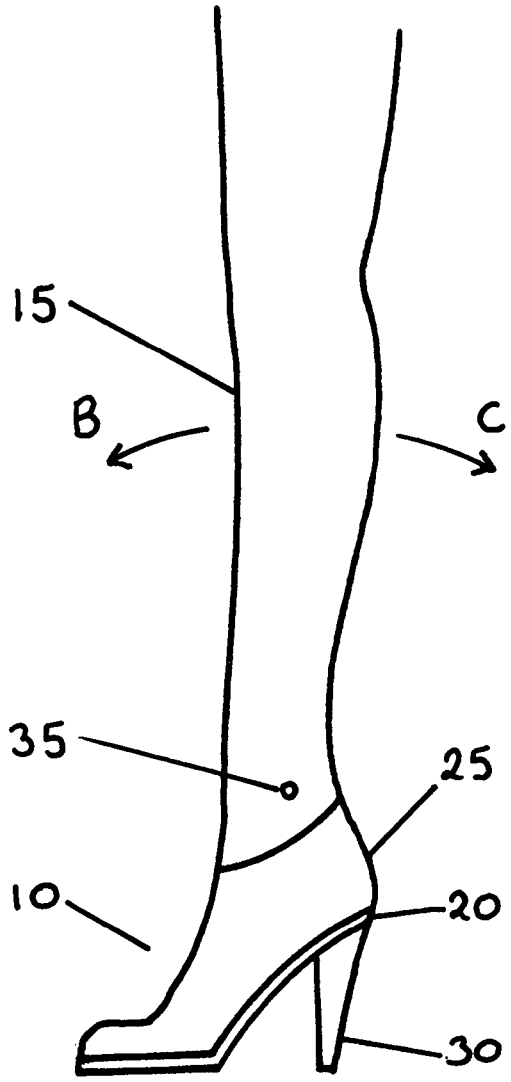
FIG. 1A is a side view of the inside of an individuals right leg.
Figure 1B:
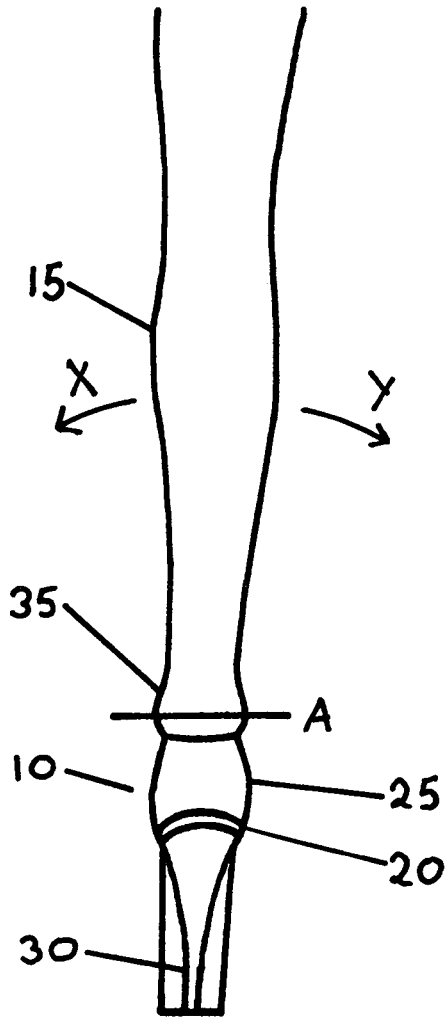
FIG. 1B is a rear view of the leg of FIG. 1A.

Referring first to FIGS. 1A and 1B there is shown a known high-heeled shoe generally indicated 10. The shoe 10 is for a right foot and is shown in use on the leg 15 of a wearer. The shoe 10 comprises a base portion 20 from which extends a body 25 and an elongate heel 30.

The normal walking action in the shoe involves a component of fore and aft rotation about the ankle joint generally indicated 35. The pivoting is therefore forwards and backwards about the axis A of the joint 35 as shown by arrows B and C.

The heel 30 is elongate and thin and therefore the contact area on the ground is small; the heel is therefore intrinsically unstable and lateral forces act on the ankle joint 35 as shown by arrows X and Y.

Figure 2A:
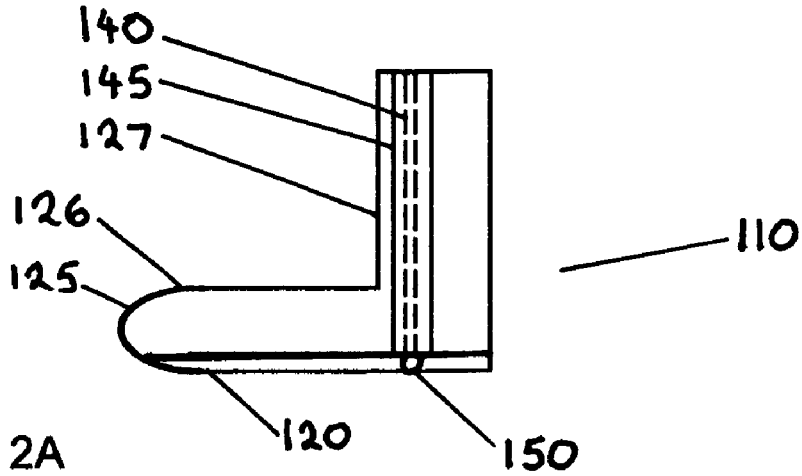
FIG. 2A is a side view of an item of footwear formed according to the present invention shown in an upright, first position.
Figure 2B:
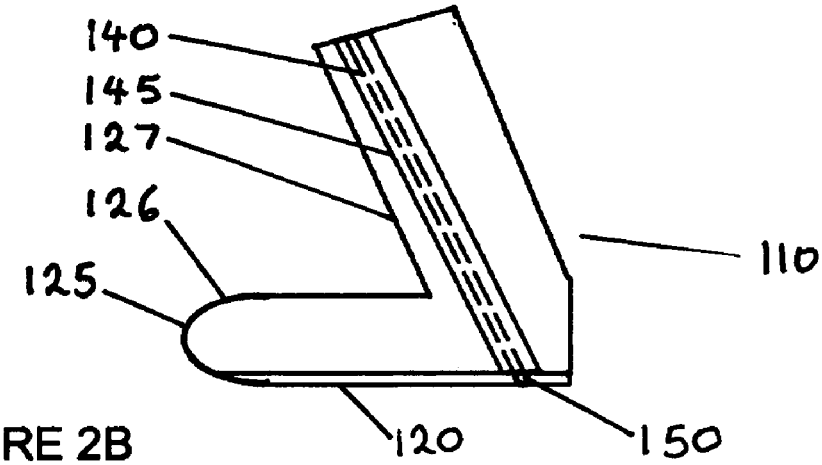
FIG. 2B is a side view of the item of footwear of FIG. 2A shown in an inclined, second position.
Figure 2C:
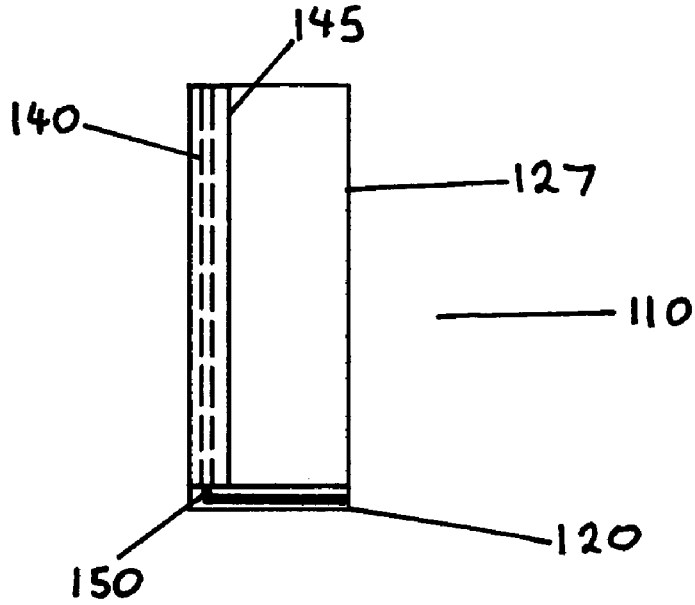
FIG. 2C is a rear view of the item of footwear shown in FIGS. 2A and 2B.

Referring now to FIGS. 2A to 2C there is shown a boot 110 according to an embodiment of the present invention.

The boot 110 includes a base 120 and a body 125 which includes a foot portion 126 and a leg portion 127.

A bracing member 140 is provided and extends from the base 120 up to the open end of the leg portion 127 so that when the boot 110 is worn the bracing member 140 extends alongside the leg of a wearer, in this embodiment to just below the level of the knee.

The bracing member 140 is housed within a fabric pocket 145 formed on the interior of the body and leg portions 126, 127.

In FIG. 2A the boot 110 is shown in a rest position as if the user was standing completely upright and still. The bracing member 140 runs approximately centrally up the side of the leg in use and thus passes through the axis of the ankle joint.

During a normal walking action the leg portion 127 will pivot forwards with respect to the base 120 as shown in FIG. 2B. In order that this natural pivoting movement of the ankle and the boot around it can be accommodated the bracing member 140 is pivotally connected to the base at pivot point 150. The pivotal connection point 150 could be achieved by any convenient means such as a roller bearing.

The bracing member 140 is formed as a metal strip and the pivotal connection point 150 allows no sideways movement of the strip 140 away from the vertical axis shown best in FIG. 2C. Accordingly, in use, the boot 110 can move between the positions shown in FIGS. 2A and 2B to accommodate natural articulation of the ankle joint and the bracing member 140 prevents any laterally inward movement of the leg by resisting this component of movement about the ankle joints.

Figure 3:
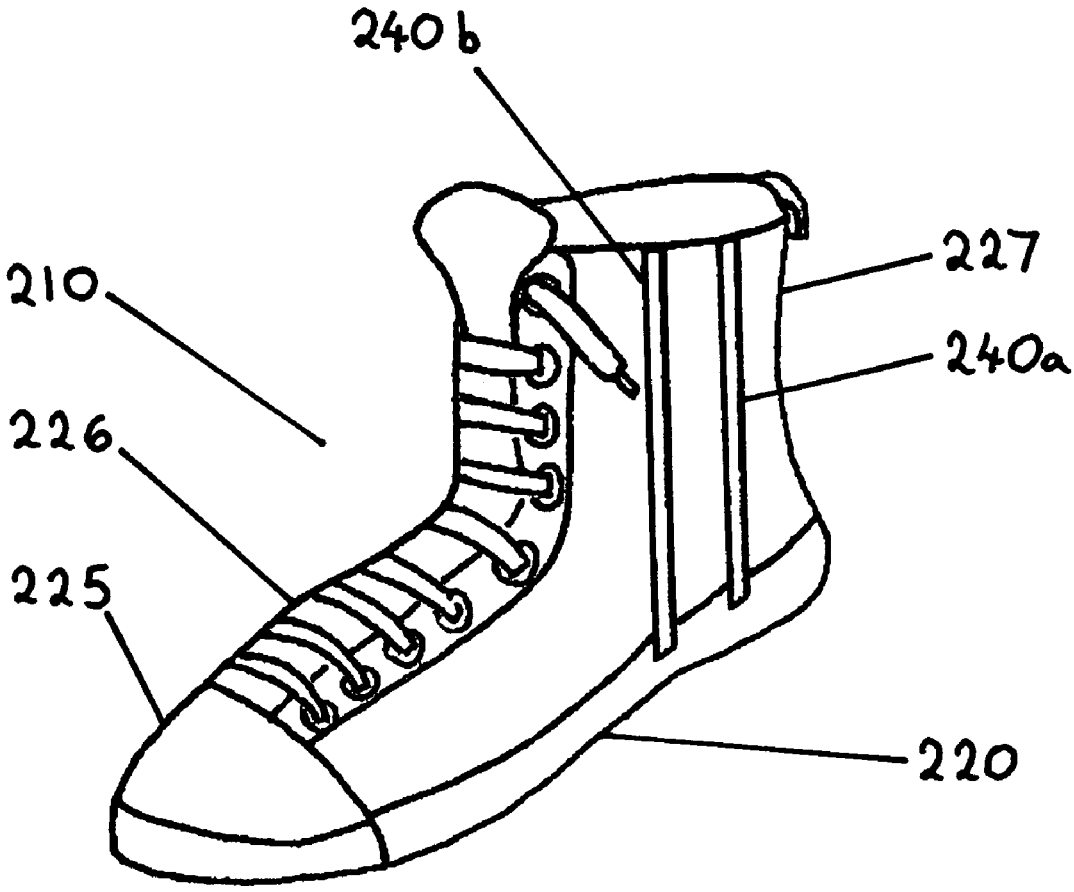
FIG. 3 is a perspective view of a boot formed with a bracing system according to the present invention.

Referring now to FIG. 3 there is shown a boot such as a sports shoe or walking shoe 210 with a body 225 comprising a foot portion 226 and a leg portion 227.

Extending up the outer face of the boot 210 are two bracing bars 240A, 240B. The bars 240A, 240B extend from the base 220 to the upper rim of the leg portion 227 and are positioned to pass either side of an ankle joint so that the joint is supported but no pressure is placed directly on the joints.

The bars 240A, 240B are fixedly connected to the base 220. In order to allow movement which is compliant with the pivoting rotation of the ankle joint, the bars 240A, 240B are formed from a plastics material. The bars 240A, 240B are formed so as to be flexible in the direction caused by rotation of the ankle but rigid laterally. Accordingly the bars 240A, 240B are thin in their dimension parallel to the axis of rotation but relatively thick in the dimension transverse the axis of rotation.

The bars 240A, 240B are positioned on the outside of the boot and on the exterior of the outside so as to be clearly visible. Because the bars 240A, 240B are formed from plastic they could be coloured to effect a design feature or transparent so as to have reduced visibility.

Figure 4A:
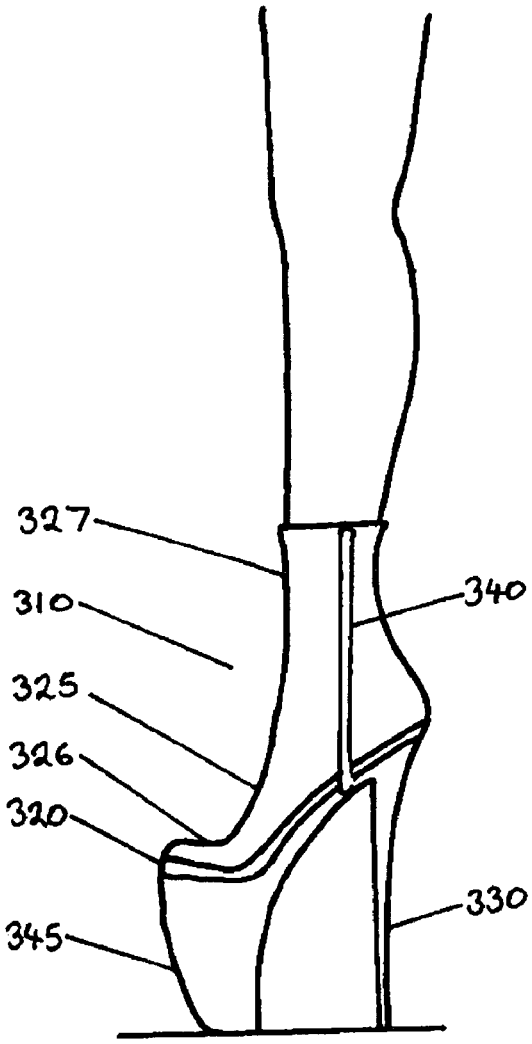
FIG. 4A is a side view of the inside of a right leg and a boot formed according to the present invention.
Figure 4B:
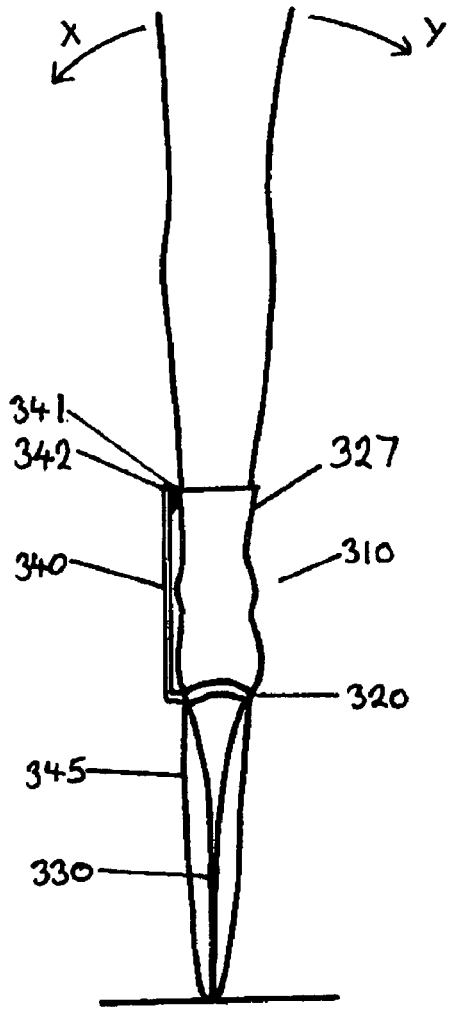
FIG. 4B is a rear view of the leg and boot shown in FIG. 4A.

Referring now to FIGS. 4A and 4B a boot 310 according to an alternative embodiment is shown.

The boot 310 comprises a base 320 which supports a body 325 comprising a foot portion 326 and a leg portion 327.

The base 320 has an elongate heel 330 to its rear and an elongate platform 345 at its front.

The boot 310 has a bracing member 340 is held against the leg portion 327 by a connector 341. The bracing member 340 is described below in more detail also in relation to FIGS. 5A and 5B.

One consideration in forming the boot 310 is weight and to this end the base 320 and the bracing member 340 should be lightweight; they may be made of hollow plastics material combined with metal bars where high forces are encountered. When constructing the final style of the footwear consideration should be given to making the support system unobtrusive, and therefore some attempt should be made to incorporate it in the finished design.

FIG. 4B shows how the front platform part 345 of the shoe base 320 narrows significantly towards its ground-engaging base. In this embodiment no attempt has been made to add stability by using a broad base. The wearer must keep balance within the inwards (X) and outwards (Y) directions.

The heel 330 is slender but that the structural components of the shoe base 320 are designed to be rigid enough so that the distance between the heel and the back of the platform 345 does not reduce significantly in use.

Figure 5A:
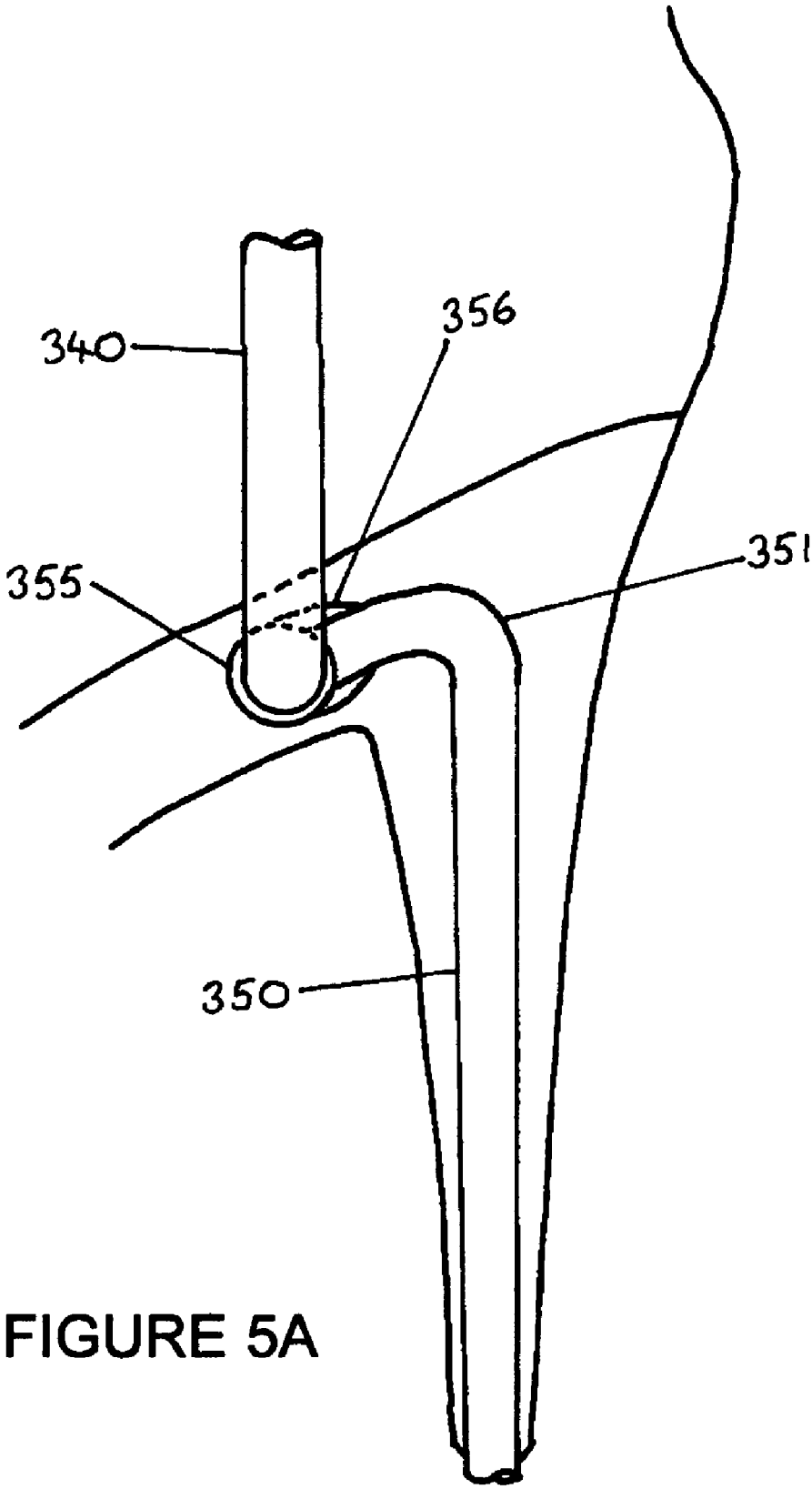
FIG. 5A is a diagrammatic side view of an articulation joint and reinforcing structure formed according to the present invention.
Figure 5B:
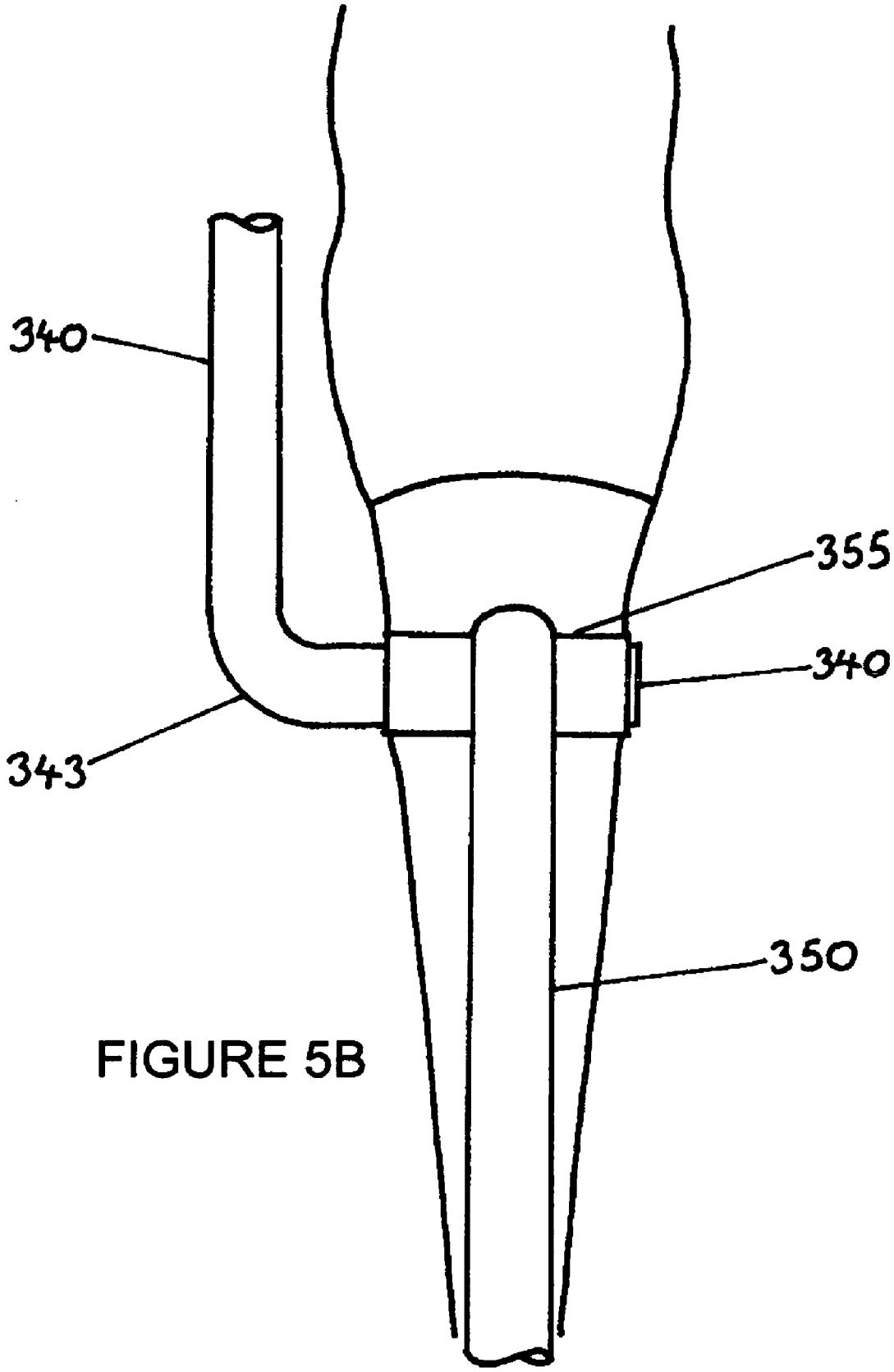
FIG. 5B is a rear view of the joint shown in FIG. 5A.

FIGS. 5A and 5B show how a heel strengthening structure is made up of a single 10 mm (4/10" inch) diameter solid metal bar to form a heel bar 350 that extends from the ground to the desired height through the centre of the heel 330. A bend 351 is then made in the heel bar 350 and the bar cut off at a position directly under the ankle. A metal tube 355 approximately 35 mm (1.5 inches) long with a close fit 10 mm (4/10" inch) diameter internal drilling is then welded (at point 356) at approximately 90 degrees to the forward/backward plane of the shoe base 320 to the heel bar 350. It is important that the drilling in the tube 355 produces a tight fit with a 10 mm (4/10" inch) diameter bar 350. For a more simple design a 10 mm (4/10" inch) drilling to accept a bracing support bar 340 can be made directly into a preformed base.

The support bar 340 is made up of a 10 mm (4/10" inch) diameter solid metal bar. In FIG. 4B the bar 340 is shown to be straight. In other embodiments, such as is shown in FIG. 6B the bar 440 is bent to follow the contours of the inner lower leg, but not passing too close to the ankle joint.

The top 342 of the support bar 340 terminates below the knee. The lower end of the bar 340 is bent through 90 degrees at bend 343 so that it can be inserted, and fit with virtually no free play, into the tube 355. The end of the support bar 340 should preferably be substantially flush with the tube 355.

Figure 5C:
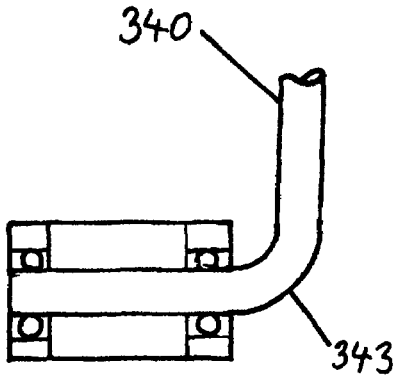
FIGS. 5C to 5G show various alternative methods for rotatably mounting a support bracing bar in a shoe base.
Figure 5D:
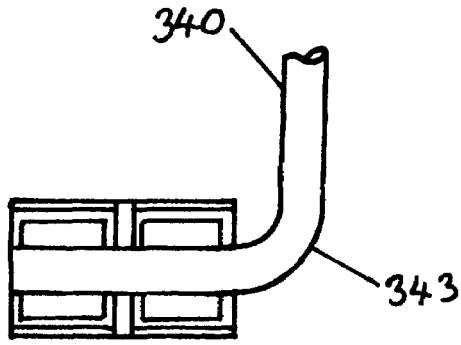
Figure 5E:
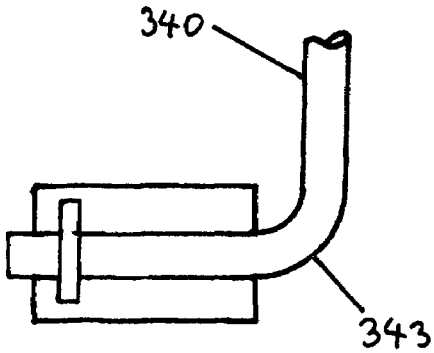
Figure 5F:
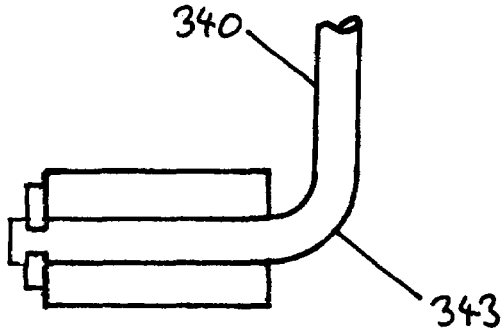
Figure 5G:
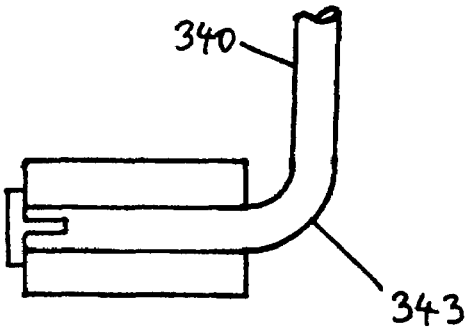

FIGS. 5C to 5G illustrate various ways in which the support bar 340 could be received in the base 320 so as to be rotatable about an axis parallel to the axis of rotation of an ankle, as best shown in FIGS. 5A and 5B. FIG. 5C shows a ball bearing joint; FIG. 5D shows a needle bearing joint; FIG. 5E shows an internal clip joint; FIG. 5F shows an external clip joint; and FIG. 5G shows a screw stop joint.

Figures 6A, 6B:
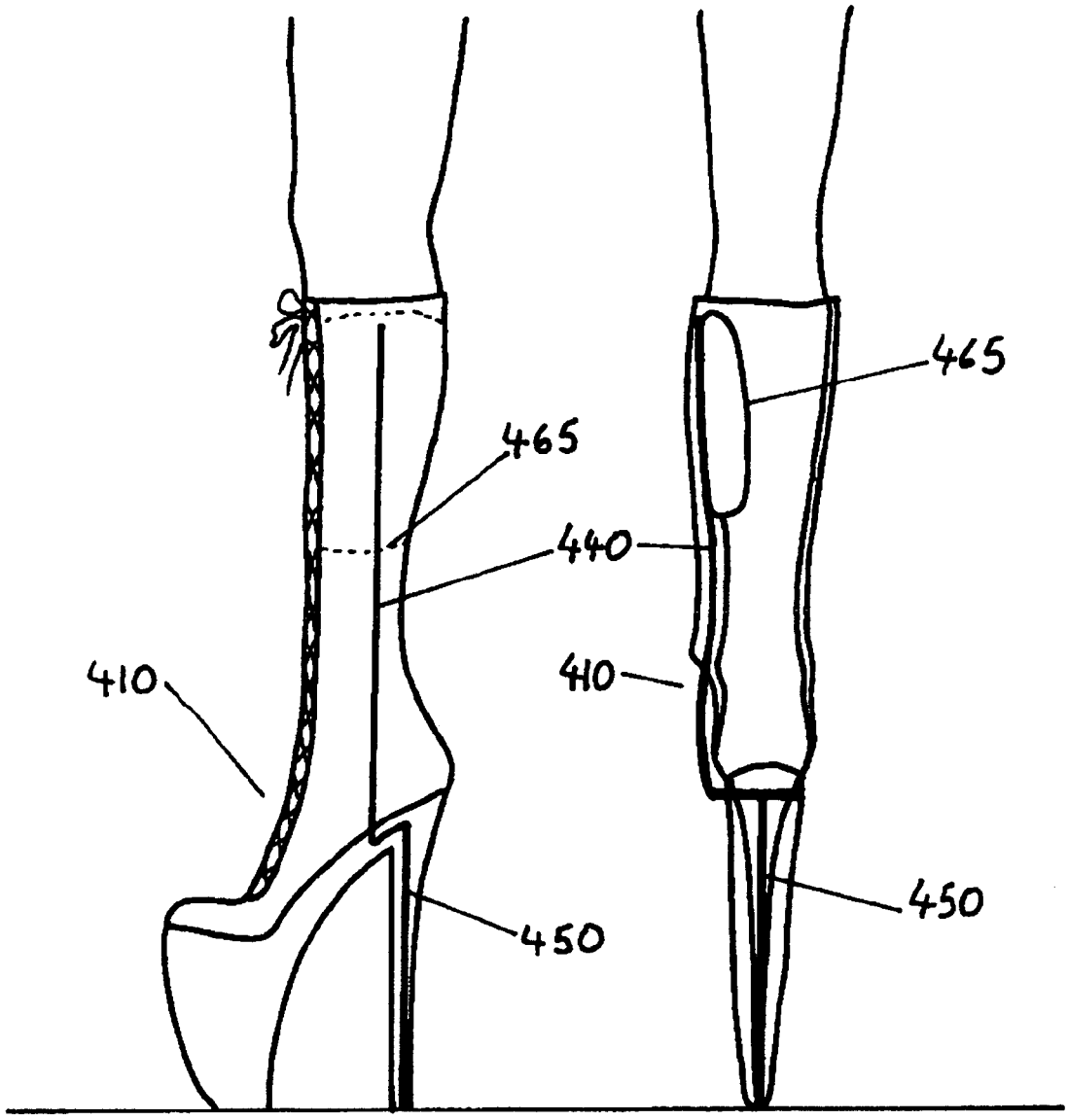
FIG. 6A is a side view of a boot formed according to an alternative embodiment.
FIG. 6B is a rear view of the boot shown in FIG. 6A.

FIGS. 6A and 6B show a boot 410 according to an alternative embodiment in which the leg portion 427 extends further up the leg than in FIGS. 5A and 5B and in which the bracing support bar 440 is enclosed in the structure of the boot 410.

FIG. 6B shows how the support bracing bar 440 follows the line of the inner lower leg, but the articulation joint does not match the ankle joint and therefore allowance must be made for the ankle to move without snagging on the support bar. At the upper end of the support bar 440 a large stiff support pad 465 is attached. This attachment should allow some movement between the bar 440 and pad 465 vertically but not in the forwards/backwards plane. The support pad rests on the inside of the leg against the shin bone. The support bar 440 and the support pad 465 can be almost completely incorporated within the material layers that make up boot structure. The rotation joint on the base is not visible from the outer side as the plastic base covers the joint. This allows the support system to be largely or completely concealed. The boot 410 should be fastened adequately to maintain the firm contact for the pad 465 against the lower leg. If the platform is very high the platform 445 itself may need some structural elements built into it.

FIGS. 6A and 6B indicate how the metal support skeletal structure of the bracing member 440 is encased in a plastic resin, pocket or similar to make up the overall form of the shoe 410.

The elevated shoe base is therefore constructed with a structural metal skeleton encased in a plastics material or similar. Metal is the choice of material for the structural supports in this embodiment as the components need to be very strong and yet at the same time relatively slender and lightweight.

Figures 7, 8, 9:
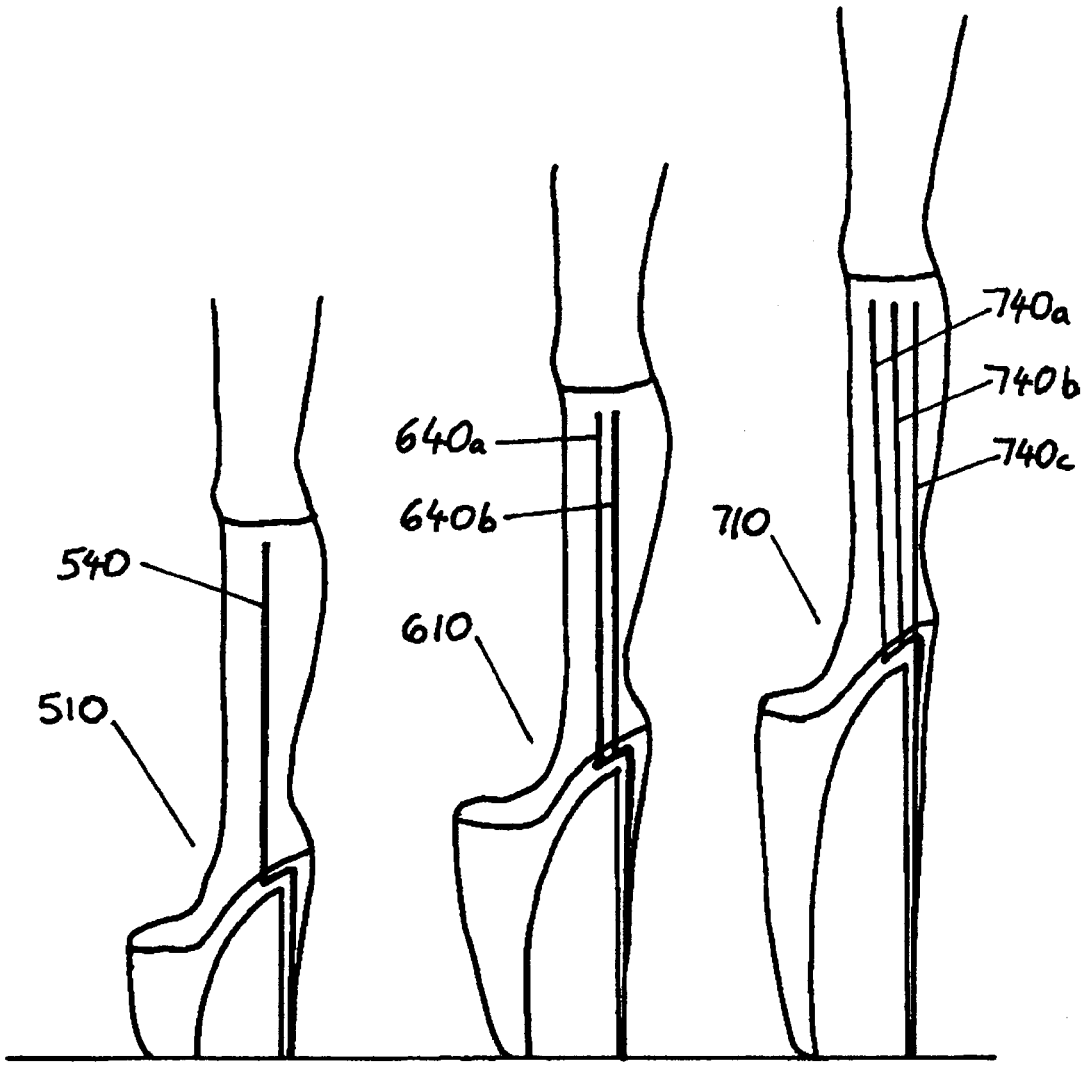
FIG. 7 is a inner side view of a boot formed with a single bracing support.
FIG. 8 is a inner side view of a boot formed with a double bracing support.
FIG. 9 is an inner side view of a boot formed with a triple bracing support.

FIG. 7 shows a boot 510 with a single bracing support bar 540. When adapting this system for extremely high footwear a double support bar system 640*a*, 640*b* (FIG. 8) or a triple support bar system 740*a*, 740*b*, 740*c* (FIG. 9) can be used.

FIGS. 7 to 9 demonstrate how the support system can be adapted to withstand the increasing sideways forces that occur with increasing heights. Each support bar 540, 640, 740 must have a dedicated tube and these should be all welded together and to the heel bar.

As shown best in relation to FIG. 6B the joint between a pad (not shown) and the support bars allows vertical movement of the bars 540, 640, 740 to take place during pivoting. This freedom of movement allows for the fact that each bar will have a slightly different articulation centre. For an overall more simple design multiple 10 mm (4/10" inch) drilling to accept the support bars can be made directly into a pre-formed base.

Figure 10:
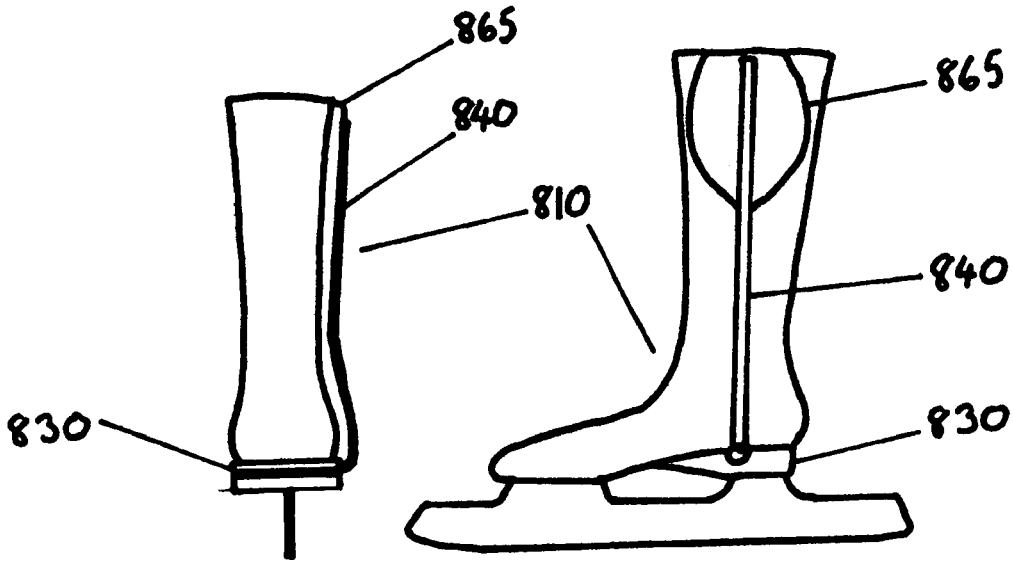
FIG. 10 is a rear and side view of an ice skating boot formed according to the present invention.

FIG. 10 shows rear and side views of an ice skating boot 810 provided with a bracing member 840 pivotally connected to its base 830. A pocket 865 retains the member 840 at the upper end of the boot.

Figure 11:
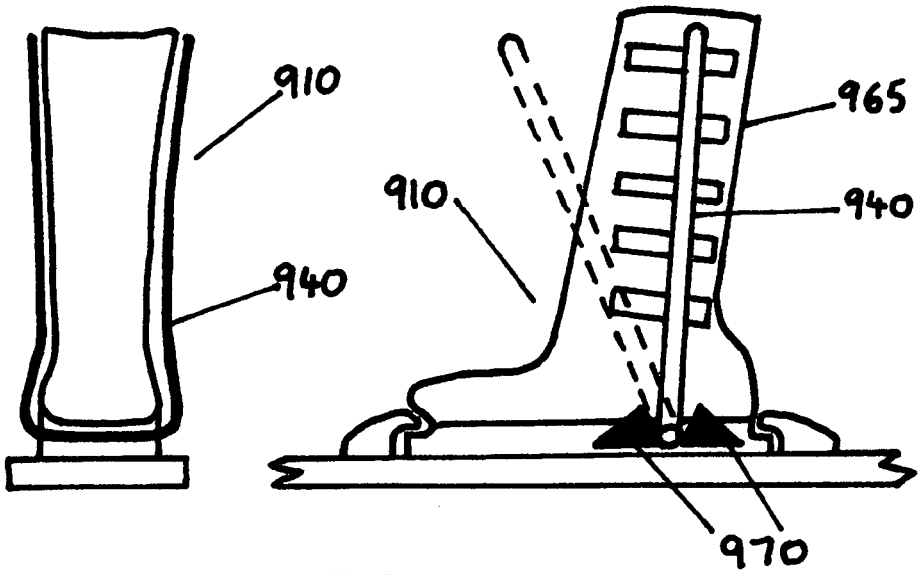
FIG. 11 is a rear and side view of a ski boot formed according to the present invention.

FIG. 11 shows rear and side views of a ski boot 910 provided with a bracing member 940 pivotally connected to its base 930. A series of pockets 965 retains the member 940 along the side of the boot. The position to which the member pivots in use is shown in phantom. A formed stop 970 restricts the forward and backward range of movement.

Figure 12:
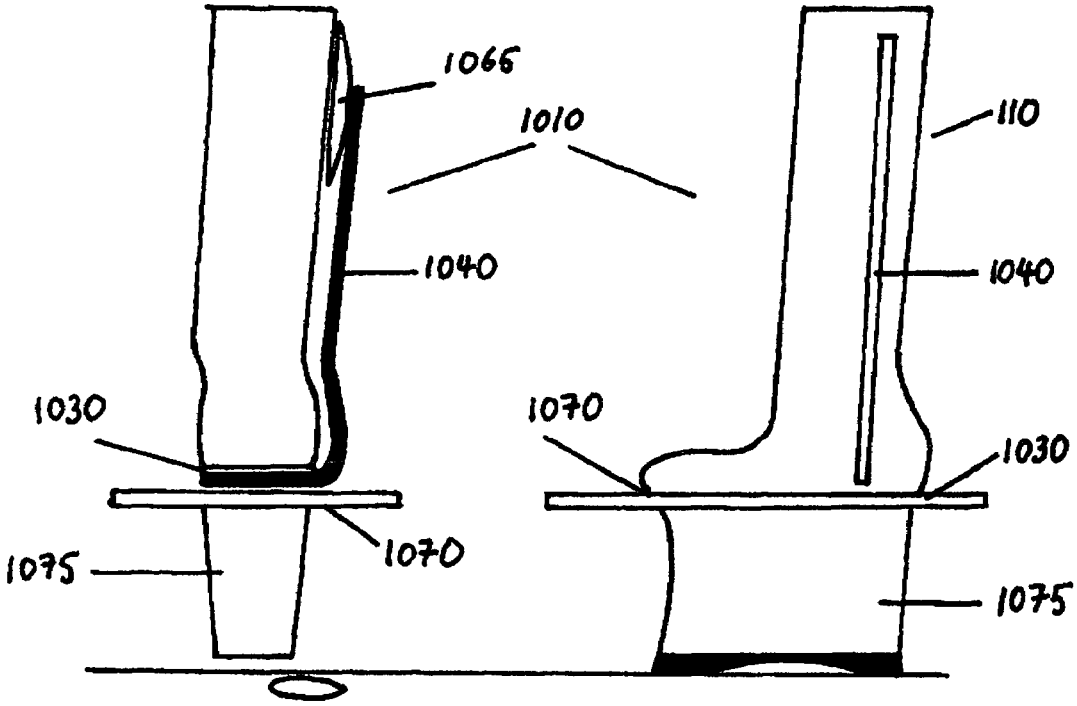
FIG. 12 is a rear and side view of a land-mine boot formed according to the present invention.

FIG. 12 shows rear and side views of a land-mine boot 1010 provided with a bracing member 1040 pivotally connected to its base 1030. A cushion 1065 supports the member 1040 at the upper end of the boot to prevent the member 1040 digging into the leg. The base 1030 is supported on a thin full-length platform 1070 from which depends a wedge-shape foot 1075 making the boot 1010 suitable for land-mine clearance.

Figure 13:
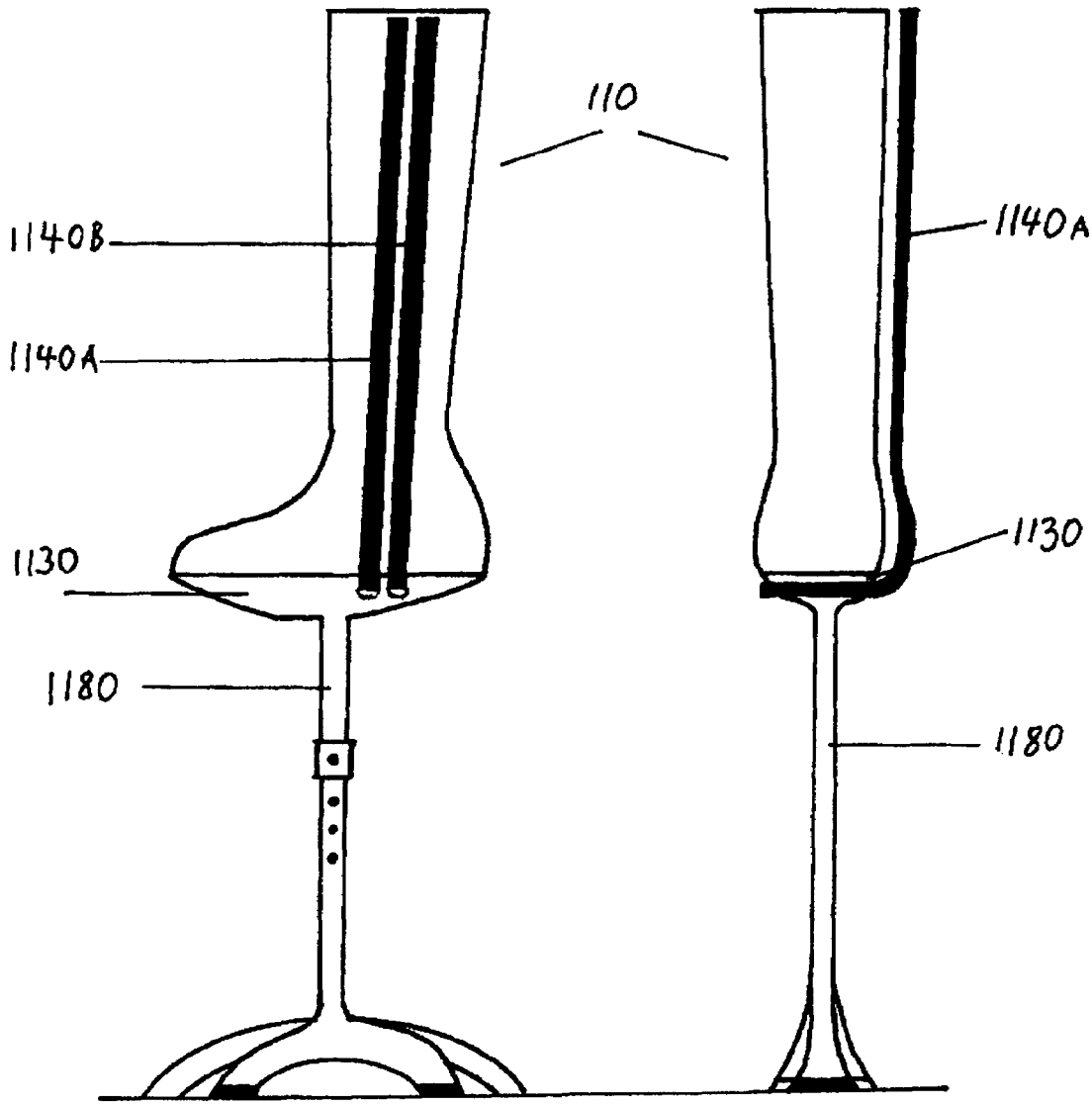
FIG. 13 is a side and rear view of a stilt-boot formed according to the present invention.

FIG. 13 shows side and rear views of a boot 1110 in which the base 1130 rides on stilts 1180. The boot 1110 is provided with a double bracing member 1140*a*, 1140*b* passing through and pivotally connected to its base 1130.

Figure 14:
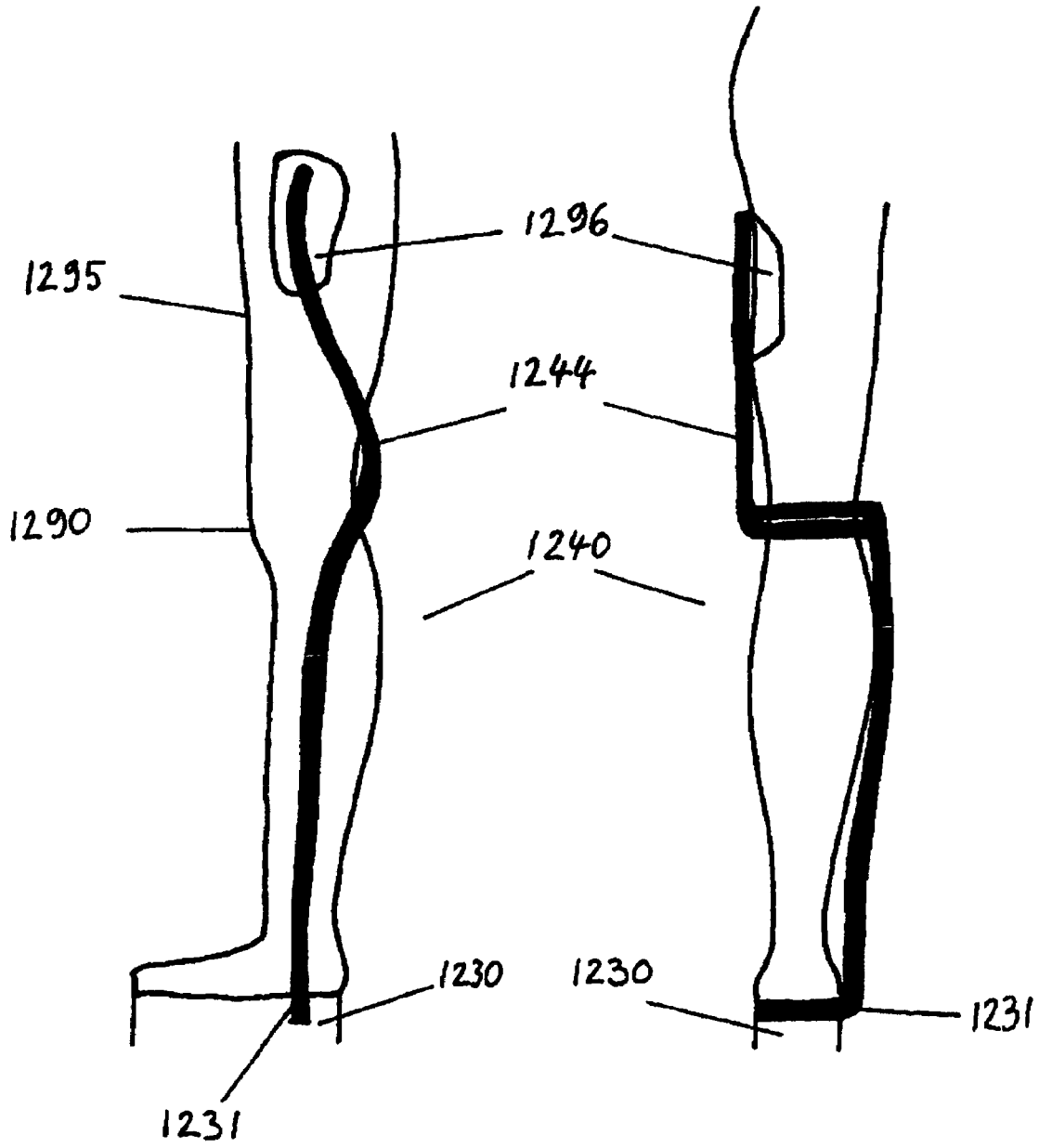
FIG. 14 is a side and rear view of an extended bracing member formed according to the present invention.

FIG. 14 shows side and rear views of a bracing member 1240 formed according to an alternative embodiment. The member 1240 is similar that those shown in FIGS. 2 to 13 in that it is connected to a base 1230 for compliant movement with an ankle joint, in this embodiment by a pivotal connection joint 1231. In this embodiment the member 1240 extends beyond the knee joint 1285 and up to the thigh 1290. At the knee joint a knee rest 1291 is provided for comfort and a thigh portion 1244 extends. A pocket and/or cushion 1296 is provided on the thigh, for example by adhesion or on an article of clothing. The pocket/cushion retains the member 1240 and/or protects the user. By extending the member 1240 above the knee the loads experienced by the ankle are spread over an even further distance so that force compensation is easier.

Figure 15:
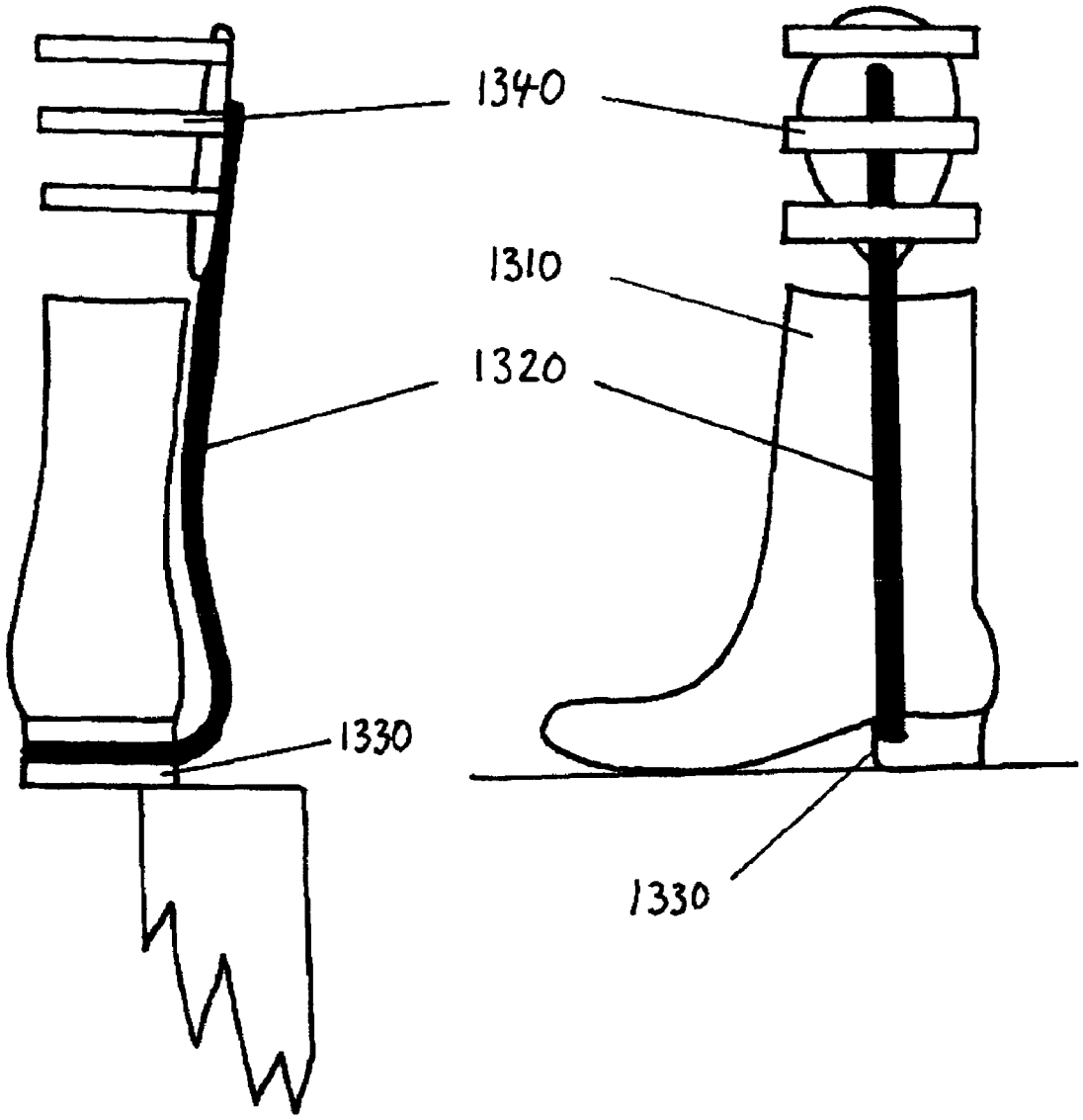
FIG. 15 is a side and rear view of a walking or work boot formed according to the present invention.

FIG. 15 shows rear and side views of a walking or work boot 1310 provided with a bracing member 1320 pivotally connected to its base 1330. A series of straps 1340 retains the member 1320 along the side of the boot. This embodiment may be developed into other applications for a bracing system including, without limitation, safety boots, walking boots, football boots, rugby boots and hockey boots.

The invention claimed is:

1. An article of footwear comprising:

an upper body;

a sole base with a high heel having a hollow tube extending transversely across the sole base; and a bracing member having a support bar pivotally connected in the hollow tube, said support bar having a heel bar extending downward from the support bar to a bottom of the heel and through the center of the heel and a brace support bar extending outwardly and upwardly from the support bar along the upper body to support the leg of a wearer;

wherein the bracing member allows for fore and aft movement of the leg while resisting lateral movement in order that a natural walking action can be achieved.

2. An article of footwear according to claim 1, in which more than one support member and hollow tubes are used with each sole base.

* * * * *